US010426265B2

(12) United States Patent
Li

(10) Patent No.: US 10,426,265 B2
(45) Date of Patent: Oct. 1, 2019

(54) CONVERTIBLE VEHICLE HAVING A TRANSPORTATION MODE AND A FIXATION MODE

(71) Applicant: Hsun Chung Li, Taoyuan (TW)

(72) Inventor: Hsun Chung Li, Taoyuan (TW)

( * ) Notice: Subject to any disclaimer, the term of this patent is extended or adjusted under 35 U.S.C. 154(b) by 0 days.

(21) Appl. No.: 15/723,612

(22) Filed: Oct. 3, 2017

(65) Prior Publication Data

US 2018/0098625 A1 Apr. 12, 2018

(30) Foreign Application Priority Data

Oct. 7, 2016 (TW) ..... 105132635 A

(51) Int. Cl.

| | |
|---|---|
| ***A47B 3/02*** | (2006.01) |
| ***A47B 85/06*** | (2006.01) |
| ***A47B 3/08*** | (2006.01) |
| ***A47B 31/04*** | (2006.01) |
| *A47B 3/10* | (2006.01) |

(52) U.S. Cl.

CPC ..... *A47B 85/06* (2013.01); *A47B 3/02* (2013.01); *A47B 3/0818* (2013.01); *A47B 31/04* (2013.01); *A47B 3/10* (2013.01)

(58) Field of Classification Search

CPC ..... A47B 85/06; A47B 31/04; A47B 3/02; A47B 3/0818; A47B 3/10; B62B 3/02; B62B 3/022; B62B 2205/06

See application file for complete search history.

(56) References Cited

U.S. PATENT DOCUMENTS 2,730,372 A * 1/1956 Mahr ..... A47B 3/0912 108/131
3,064,989 A * 11/1962 Bellows ..... B62B 1/002 280/47.18

(Continued)

FOREIGN PATENT DOCUMENTS

CN 103978998 A 8/2014

*Primary Examiner* — Jacob B Meyer
(74) *Attorney, Agent, or Firm* — Muncy, Geissler, Olds & Lowe, P.C.

(57) ABSTRACT

A convertible vehicle having a transportation mode and a fixation mode is disclosed. The convertible vehicle includes a framework assembly, a plurality of wheels connected to the framework assembly, and a carrier member pivotally connected to the framework assembly. The framework assembly includes a first framework unit and a second framework unit pivotally connected to each other. In the fixation mode of the convertible vehicle, the first framework unit and the second framework unit are folded to form a horizontal platform, each of the wheels is located at a lower surface of the first framework unit or the second framework unit and located at a horizontal plane for transportation, and the carrier member is placed on the horizontal platform for carrying objects. In the fixation mode of the convertible vehicle, the first framework unit and the second framework unit are unfolded to be inclined and to form an X-shape structure, each of the wheels is located at the lower surface of the inclined first framework unit or the inclined second framework unit, and the carrier member is placed on the framework for carrying objects.

12 Claims, 17 Drawing Sheets

(56) References Cited

U.S. PATENT DOCUMENTS 3,752,527 A * 8/1973 Ferneau ..... A61G 1/052 108/120
3,785,669 A * 1/1974 Doheny ..... B62B 1/002 280/47.18
4,284,286 A * 8/1981 Lewallen ..... B62B 1/002 280/30
4,505,495 A * 3/1985 Foss ..... B62B 3/02 16/113.1
4,637,626 A * 1/1987 Foss ..... A45C 13/385 16/113.1
4,921,270 A * 5/1990 Schoberg ..... B62B 1/002 280/47.27
4,934,718 A 6/1990 Voegele
5,154,441 A * 10/1992 White ..... A47B 31/04 108/120
5,160,182 A * 11/1992 Chang ..... A47C 13/00 280/30
5,228,716 A * 7/1993 Dahl ..... B62B 1/002 280/47.18
5,476,282 A * 12/1995 Dahl ..... B62B 1/002 280/47.18
5,536,034 A * 7/1996 Miller ..... B62B 1/002 108/11
D373,877 S * 9/1996 Tsai ..... D25/66
5,775,865 A * 7/1998 Capilupi, Jr. ..... B62B 5/0003 280/47.2
6,019,381 A * 2/2000 Krawczyk ..... B62B 1/002 211/126.1
6,079,941 A * 6/2000 Lee ..... B62B 3/04 16/35 R
6,234,497 B1 * 5/2001 Stahler, Sr. ..... B62B 1/002 280/47.29
6,328,319 B1 * 12/2001 Stahler, Sr. ..... B62B 1/002 280/47.18
6,345,829 B1 * 2/2002 Mueller ..... B23D 47/025 280/47.18
6,364,328 B1 * 4/2002 Stahler, Sr. ..... B62B 1/002 280/47.18
6,530,583 B1 * 3/2003 Mueller ..... B23D 47/025 144/286.5
6,578,856 B2 * 6/2003 Kahle ..... B23D 57/0092 108/119
6,698,361 B2 * 3/2004 Lung ..... A47B 3/02 108/118
6,880,835 B2 * 4/2005 Tornabene ..... B62B 1/002 182/20
6,966,574 B1 * 11/2005 Dahl ..... B62B 1/002 280/47.18
7,093,840 B2 * 8/2006 Lucas ..... B60B 37/00 182/20
7,377,525 B1 * 5/2008 Whitmore ..... B25H 1/04 280/39
7,513,511 B2 * 4/2009 Chaseateau ..... B62B 1/002 280/43.1
7,806,426 B2 * 10/2010 Van Landingham, Jr. ..... B62B 3/02 280/47.35
8,042,829 B2 * 10/2011 Hailston ..... B62B 3/008 280/30
8,070,181 B2 * 12/2011 Forrest ..... B62B 3/02 280/35
8,100,430 B2 * 1/2012 Meyers ..... B62B 1/002 280/30
8,448,956 B2 * 5/2013 Wise ..... B25H 1/04 280/30
8,465,046 B2 * 6/2013 Meyers ..... B62B 1/002 280/30
8,540,273 B2 * 9/2013 Dobrachinski ..... B62B 3/027 280/47.34
8,764,046 B2 * 7/2014 Baldemor ..... B62B 1/002 280/47.29
8,950,343 B2 * 2/2015 Huang ..... A47B 3/02 108/116
9,221,484 B2 * 12/2015 Logvin ..... B62B 3/02
9,365,225 B2 * 6/2016 Henao ..... B62B 3/02
9,623,889 B2 * 4/2017 Wallace-Riley ..... B62B 3/004
9,688,298 B1 * 6/2017 Su ..... B62B 1/002
10,106,182 B2 * 10/2018 Camarco ..... B62B 3/022
10,112,634 B1 * 10/2018 Davydov ..... B62B 3/027
10,118,633 B2 * 11/2018 Gibson ..... B62B 3/022
2001/0045718 A1 * 11/2001 Boirum ..... B25H 3/02 280/47.26
2002/0105169 A1 * 8/2002 Dahl ..... B62B 1/002 280/651
2003/0136308 A1 * 7/2003 Lung ..... A47B 3/02 108/12
2008/0271649 A1 * 11/2008 Leng ..... A47B 3/02 108/119
2010/0032927 A1 * 2/2010 Gordon ..... A47B 3/10 280/659
2010/0219615 A1 * 9/2010 Forrest ..... B62B 3/02 280/638
2010/0320732 A1 * 12/2010 Dobrachinski ..... B62B 3/027 280/651
2011/0115198 A1 * 5/2011 Dobrachinski ..... B62B 3/027 280/651
2016/0286951 A1 * 10/2016 Chung ..... A47B 9/16
2016/0286955 A1 * 10/2016 Cohen ..... A47B 31/04
2017/0166229 A1 * 6/2017 Camarco ..... B62B 3/022
2018/0098625 A1 * 4/2018 Li ..... A47B 3/02

* cited by examiner

CONVERTIBLE VEHICLE HAVING A TRANSPORTATION MODE AND A FIXATION MODE

CROSS-REFERENCE TO RELATED APPLICATIONS

The present application claims the benefits of the TW patent application serial no. 105132635, filed on Oct. 7, 2016, which is incorporated herein by reference in its entirety.

TECHNICAL FIELD

The present invention relates to a convertible vehicle having a transportation mode and a fixation mode and in particular to one having a horizontally placed carrier member used for carrying, transporting heavy objects and forming a table board.

BACKGROUND

It's inevitable to carry heavy objects in daily life, and most people would use trolleys for transporting heavy objects to achieve the purpose of transportation in a quick manner. But most trolleys have only transport function and can only be placed in the warehouse when not used. It would take a lot of space and lack of economic benefits as well.

China Patent No. CN103978998A disclosed a multi-purpose trolley which can realize the transformation from a trolley to a table. The disclosed trolley contains a panel, a U-shaped push rod and directional wheels, each of the directional wheels is installed at the bottom of the panel. The trolley performs its general purpose of transportation when the U-shaped push rod is installed on the panel, and the trolley forms a table when both sides of the panel were respectively installed with a U-shaped push rod and then inverted.

However, in the above-mentioned prior art, the table is supported against the ground by having the two U-shaped push rods and the two U-shaped push rods, the panel and the ground forms a mobile quadric linkage structure rather than a locked chain. Hence, the panel is supported in a very unstable manner and easily to be shaken so that the formed table in this case is easily dumped by external forces. In addition, only one U-shaped push rod is employed when the trolley is used to move heavy objects to the distant place and a table cannot be formed in this way. Therefore, if the user wants to transform the trolley into the table, the user must carry the second U-shaped push rod to achieve the purpose of forming a table. But the second U-shaped push rod is so cumbersome and would cause trouble during transport. Thus, the transformation of the disclosed trolley has the instability and inconvenience during application.

In addition, as described in U.S. Pat. No. 4,934,718, a device having function of hand truck and table is disclosed to have two wheels 9 and a toe plate 7 pivotally mounted at the bottom end of a frame 2. A support rod 5 is pivotally mounted on the frame 2 and a table 10 is arranged between the top end of the support rod 5 and the frame 2 so that the device can be transformed between an upright trolley and a dining table. However, the disclosed device is a two-wheeled trolley, and the trolley could not be put on the ground for stacking and transporting goods. Users can only use the small toe plate 7 to bear objects; hence, the number and volume of carried goods are limited and the transportation capability of the device is constrained. In addition, the toe plate 7 and the table 10 are two components which cannot be interchanged. The structure cannot be simplified and there is a need for improvement.

The inventor of the present invention has learned from this and conducted research to disclose a convertible vehicle having a transportation mode and a fixation mode.

SUMMARY

One object of the present invention is directed to providing a convertible vehicle having a transportation mode and a fixation mode, comprising: a framework assembly comprising a first framework unit and a second framework unit pivotally connected to each other; a plurality of wheels connected to the framework assembly; and a carrier member pivotally connected to the framework assembly; wherein in the fixation mode of the convertible vehicle, the first framework unit and the second framework unit are folded to form a horizontal platform, each of the wheels is located at a lower surface of the first framework unit or the second framework unit and located at a same horizontal plane for transportation, and the carrier member is placed on the horizontal platform for carrying objects; and wherein in the fixation mode of the convertible vehicle, the first framework unit and the second framework unit are unfolded to be inclined and to form an X-shape structure, each of the wheels is located at the lower surface of the inclined first framework unit or the inclined second framework unit, and the carrier member is placed on the framework for carrying objects.

The convertible vehicle having a transportation mode and a fixation mode disclosed in the present invention further comprises a handle pivotally mounted on the framework assembly with function of being folded along a direction toward the horizontal platform and being unfolded along a direction away from the horizontal platform to include an angle with the horizontal platform.

The convertible vehicle having a transportation mode and a fixation mode disclosed in the present invention has the following features and advantages:

1. Dual function of carrying heavy objects and serving as a table by combining a single carrier member component; hence achieving dual-use and simplified structure.
2. When the present invention is in the transportation mode, it can be placed horizontally on the ground to facilitate the user to stack goods on the carrier member and the convenience and quantity of transportation would be enhanced.
3. When the present invention is in the fixation mode, each of the wheels is located at a lower surface of the first framework unit or the second framework unit, and the wheels are not in contact with the ground, and the first and second framework units steadily support on the ground to enhance the safety of use.

The foregoing aspects and the accompanying advantages of this invention will become more readily appreciated as the same becomes better understood by reference to the following detailed description, when taken in conjunction with the accompanying drawings.

DESCRIPTION OF THE PREFERRED EMBODIMENT

Referring to FIGS. 1 to 6, a convertible vehicle having a transportation mode and a fixation mode disclosed in the present invention comprises a framework assembly 10 comprising a first framework unit 10*a* and a second framework unit 10*b* pivotally connected to each other such that the first framework unit 10*a* and the second framework unit 10*b* may be unfolded to be inclined and therefore form an X-shape structure or folded into a horizontal platform 11; a plurality of wheels 20 connected to the framework assembly 10; and at least one carrier member 30 pivotally connected to the framework assembly 10 and either placed on the top of the X-shape structure or on the horizontal platform 11.

In the transportation mode of the convertible vehicle where the first framework unit 10*a* and the second framework unit 10*b* of the framework assembly 10 are folded to form the horizontal platform 11, each of the wheels 20 may be located at a lower surface of the first framework unit 10*a* or the second framework unit 10*b* such that all of the wheels could be located at a same horizontal plane for transportation and the carrier member 30 could be placed on the horizontal platform 11 for carrying objects when the first framework unit 10*a* or the second framework unit 10*b* are folded. In the fixation mode of the convertible vehicle where the first framework unit 10*a* and the second framework unit 10*b* are unfolded to form the X-shape structure, each of the wheels 20 may be located at a lower surface of the inclined first framework unit 10*a* or the inclined second framework unit 10*b* such that the carrier member 30 could be placed on the top of the X-shape structure for placing objects.

The present invention discloses a convertible vehicle having a transportation mode and a fixation mode, wherein the first and second framework units 10*a*, 10*b* may function to be the unfolded X-shape structure or the folded platform and may have many specific implementations for those skilled in the art. For example, each of the first and second framework units 10*a*, 10*b* may be formed to be but not limited to a plate or a frame. Each of the first and second framework units 10*a*, 10*b* is preferably a quadrilateral frame and more preferably a rectangular frame so that the first and second framework units 10*a*, 10*b* may be unfolded to form the X-shape structure or folded to form the horizontal platform.

In one embodiment, the first framework unit 10*a* is a rectangular frame while the second framework unit 10*b* is a rectangular plate such that the first and second framework units 10*a*, 10*b* may be either unfolded to form the X-shape structure or folded to form the horizontal platform.

In another embodiment, the first and second framework units 10*a*, 10*b* may be I-shaped frames that are pivoted with each other such that the first and second framework units 10*a*, 10*b* may be unfolded to form the X-shape structure or folded to form the horizontal platform.

Figure 19:
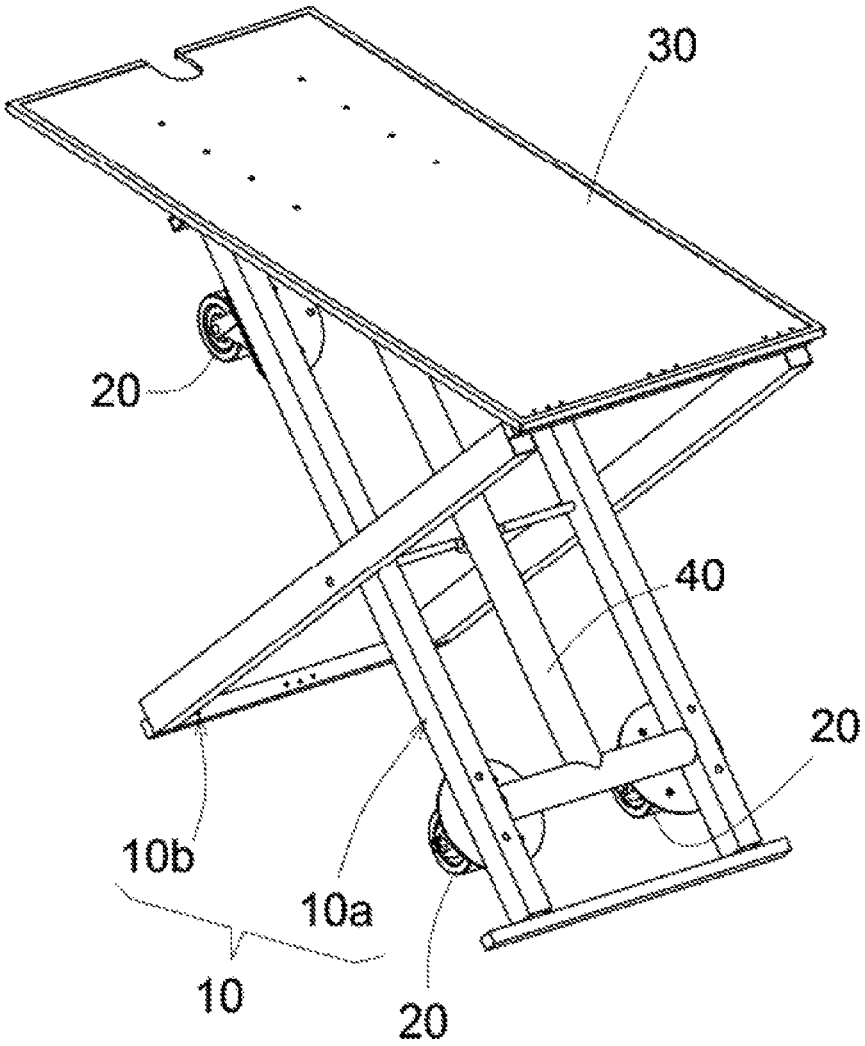
FIG. 19 is a diagram schematically illustrating a fixation mode of the convertible vehicle of FIG. 15.
Figure 20:
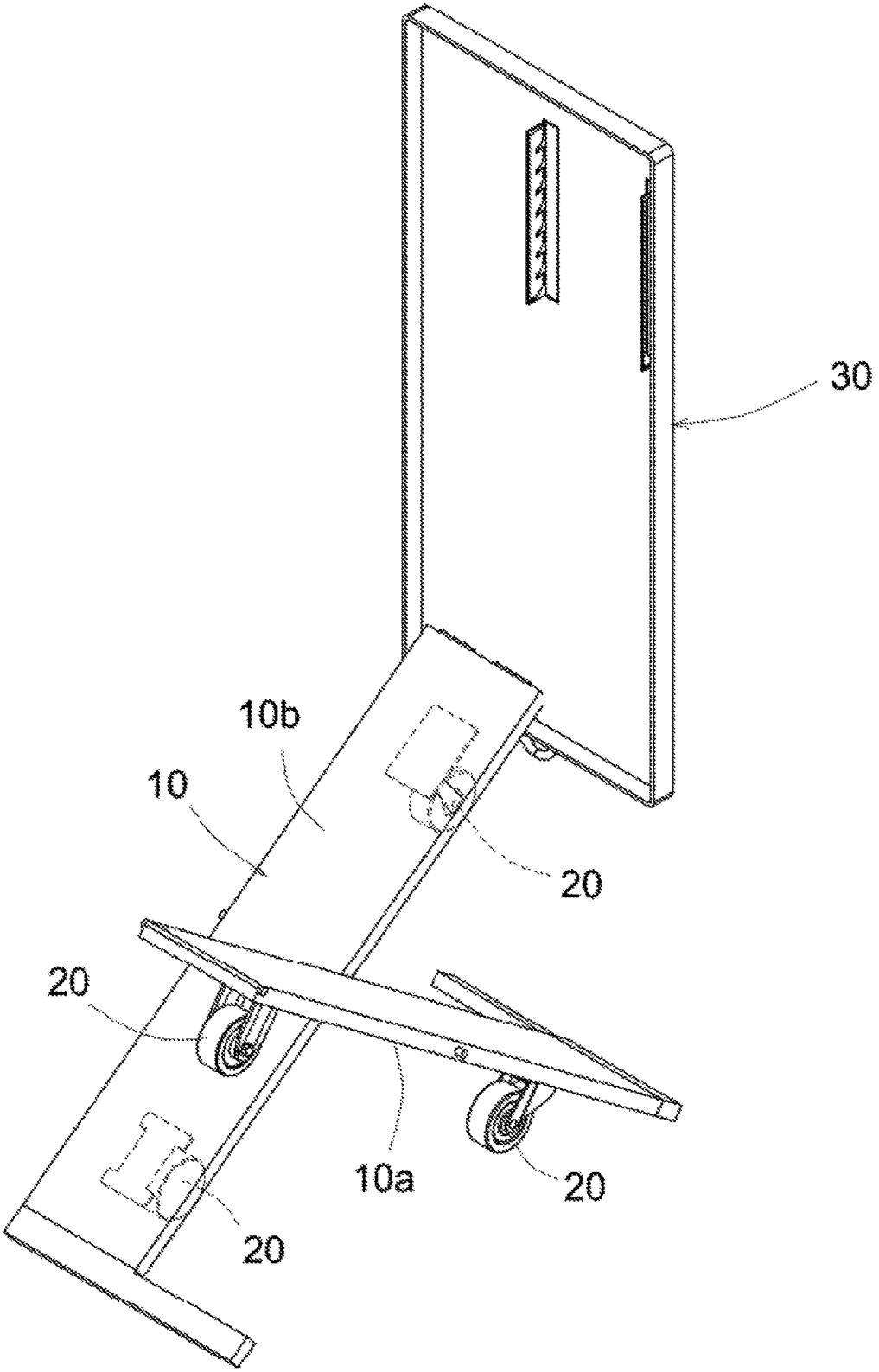
FIG. 20 is a diagram schematically showing a convertible vehicle according to a third embodiment of the present invention.
Figure 21:
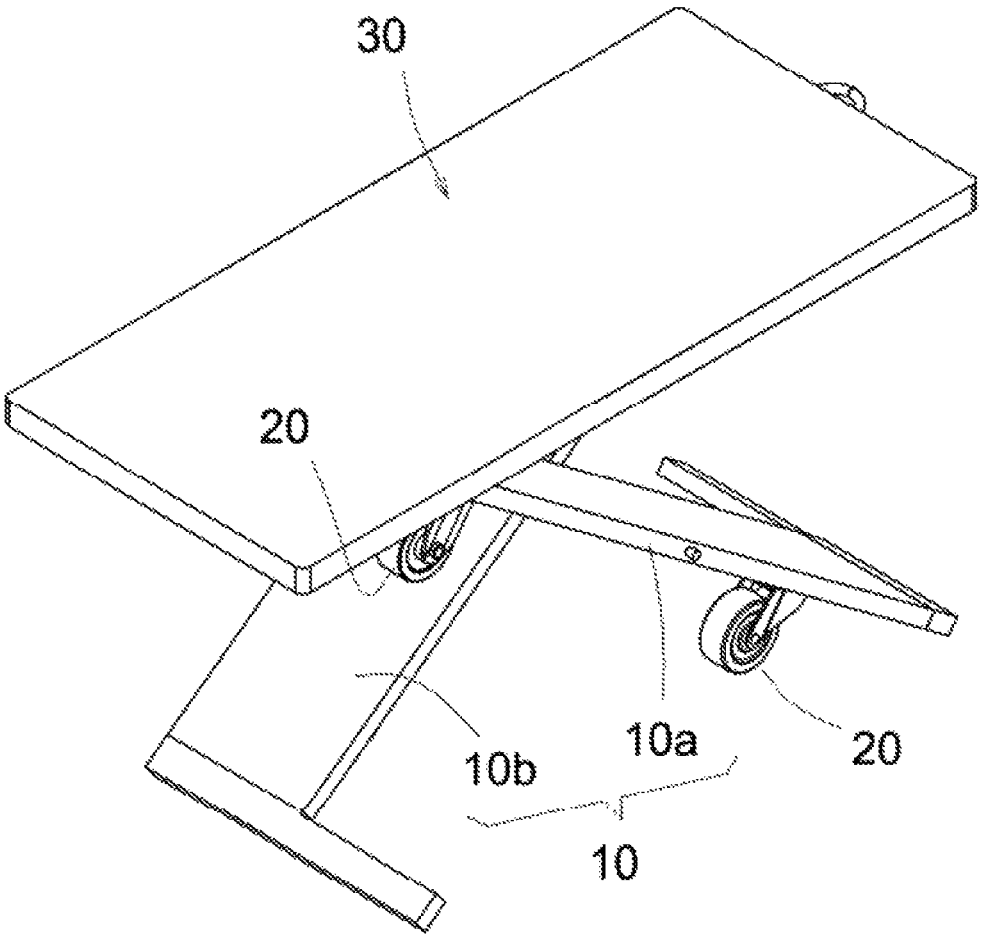
FIG. 21 is a diagram schematically showing a fixation mode of the convertible vehicle of FIG. 20.

In the embodiments shown in FIGS. 19 and 20, the first and second framework units 10*a*, 10*b* may be solid or hollow rectangular plates or frames that are pivotally connected to each other such that the first and second framework units 10*a*, 10*b* could be unfolded to form the X-shape or folded to form the horizontal platform 11. Specifically, the first and second framework units 10*a*, 10*b* are adjacent to each other after being folded to form the horizontal platform 11. The carrier member 30 is either placed on the top of the X-shape structure formed by unfolding the first and second framework units 10*a*, 10*b* or placed on the horizontal platform 11 formed by folding the first and second framework units 10*a*, 10*b*.

The carrier member 30 may be but not limited to a plate or a frame. The carrier member 30 may be but not limited to be fixedly pivotally connected to the first framework unit 10*a*, fixedly pivotally connected to the second framework unit 10*b*, or removably connected to the framework assembly 10.

The disclosed carrier member 30 may be designed as a honeycomb type. The honeycomb type plane may be configured for enhancing the strength of the table and for accommodating the wheels that are designed to be detachably mounted so as to reduce the thickness of the trolley and to be applicable for storage at home or transportation with cars.

In another embodiment, the disclosed carrier member 30 may be designed as a hollow box for storing articles including but not limited to tools. The stored goods can be transported in the transportation mode of the convertible vehicle and then placed on the table formed in the fixation mode of the convertible vehicle.

In one embodiment, the disclosed convertible vehicle further comprises a handle 40 pivotally mounted on the framework assembly 10 so that the handle 40 may be folded along a direction toward the horizontal platform 11 or unfolded along a direction away from the horizontal platform 11 to have an included angle A with the horizontal platform 11.

Figure 2:
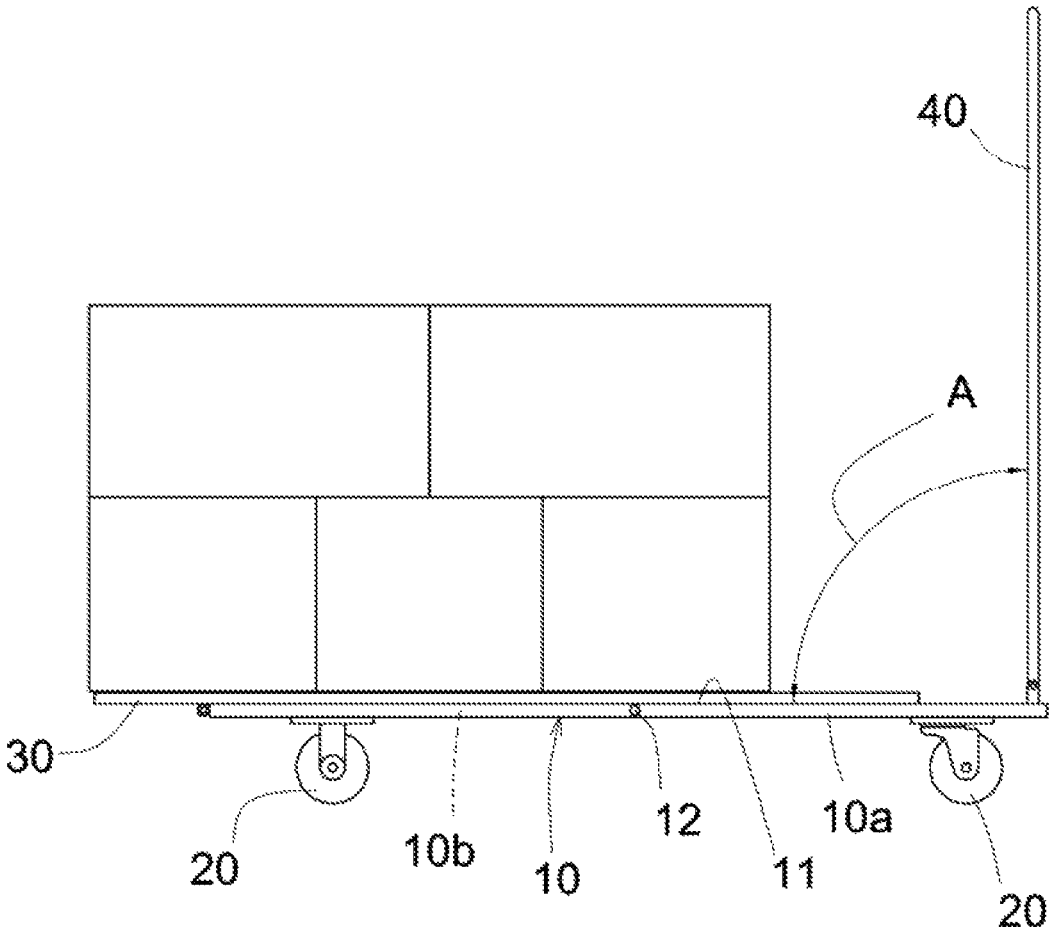
FIG. 2 is a diagram schematically showing another transportation mode of the convertible vehicle having a transportation mode and a fixation mode according to one embodiment of the present invention.

As shown in FIG. 2, the angle A between the handle 40 and the horizontal platform 11 may be but not limited to 90 degrees or more than 90 degrees, usually between 90 and 120 degrees.

The number of wheels 20 may be but not limited to two, three, four, and so on. The number of wheels 20 is preferably three or more so as to form a plane. The number of wheels 20 is most preferably four so as to form a commercially available trolley. The wheels 20 may be either all configured in the first framework unit 10*a* or all configured in the second framework unit 10*b*. Alternatively, the wheels 20 may be separately provided in the first and second framework units 10*a* and 10*b*, as shown in FIG. 20.

In one embodiment, each of the wheels 20 is not configured at the four corners of the first framework unit 10*a* and/or the second framework unit 10*b*.

In a preferred embodiment, when the framework assembly 10 is unfolded to form the X-shape structure, each of the wheels 20 does not touch the ground but the rigid first and second framework units 10*a*, 10*b* touch the ground to steadily support the carrier member 30 and provide a more stable table for users to stack items.

In another embodiment, when the framework assembly 10 is unfolded to the X-shape structure, the first and second framework units 10*a*, 10*b* and each of the wheels 20 all touch the ground to increase landing area of the convertible vehicle. Since each of the wheels 20 touches the ground, the convertible vehicle in the fixation mode still has the function for assisting movement.

Figure 1:
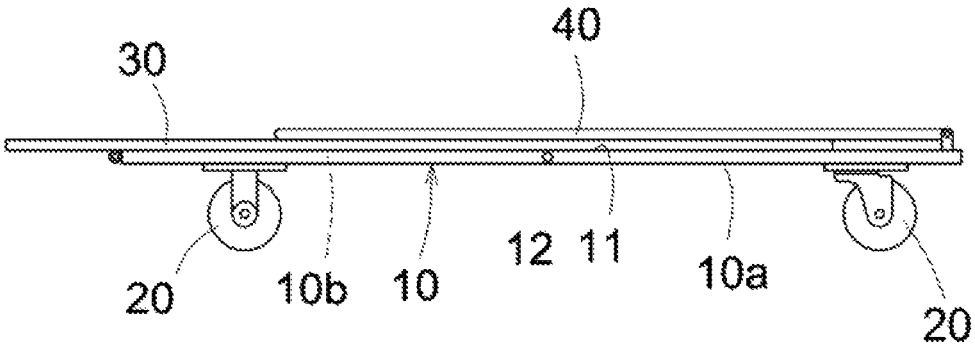
FIG. 1 is a diagram schematically showing a transportation mode of a convertible vehicle having a transportation mode and a fixation mode according to one embodiment of the present invention.
Figure 3:
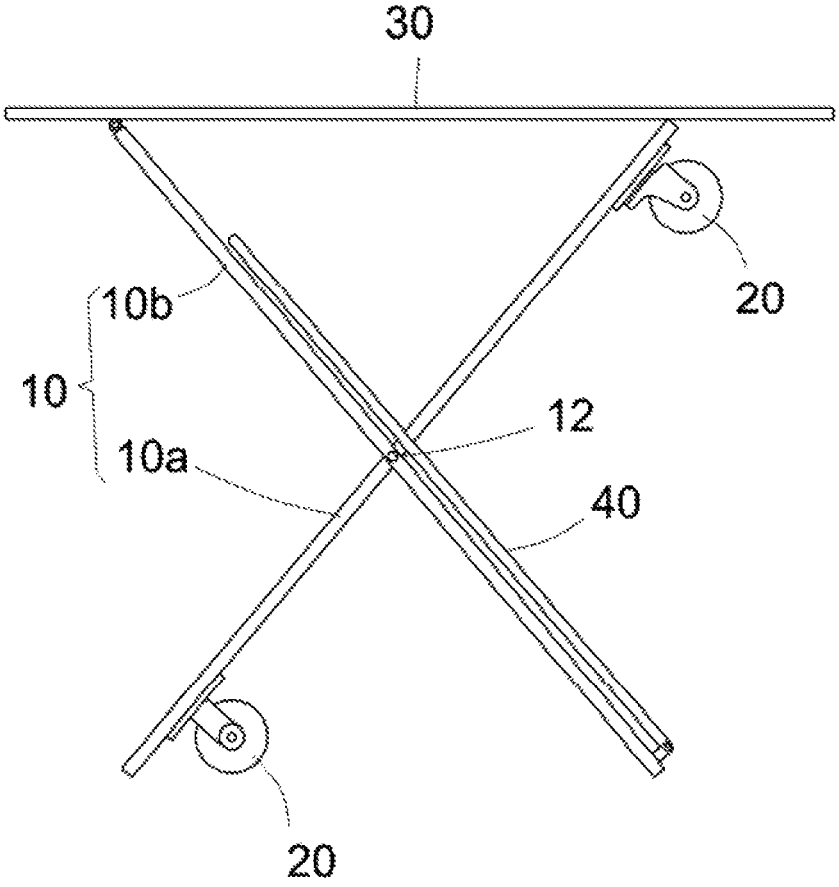
FIG. 3 is a diagram schematically showing a fixation mode of the convertible vehicle having a transportation mode and a fixation mode according to one embodiment of the present invention.

As shown FIGS. 1 and 3, in one embodiment of the convertible vehicle having a transportation mode and a fixation mode, the middle parts of the first and second framework units 10*a*, 10*b* are pivotally connected to each other with a pivot shaft 12, so that the first framework unit 10*a* and the second framework unit 10*b* may be relatively rotatable relative to the pivot shaft 12 for being unfolded to form the X-shape structure or being folded. Furthermore, the first framework unit 10*a* and the second framework unit 10*b* may be folded in an internal and external manner and the widths of the first and second framework units 10*a*, 10*b* are substantially equal to the width of the pivot shaft 12 and the first and second framework units 10*a*, 10*b* are provided with frame bars against the carrier member 30 and the ground so as to achieve stronger mechanic strength. For example, the second framework unit 10*b* may be larger than the first framework unit 10*a* so that the second framework unit 10*b* is at the external side and the first framework unit 10*a* is at the internal side, as shown in FIG. 7.

Figure 7:
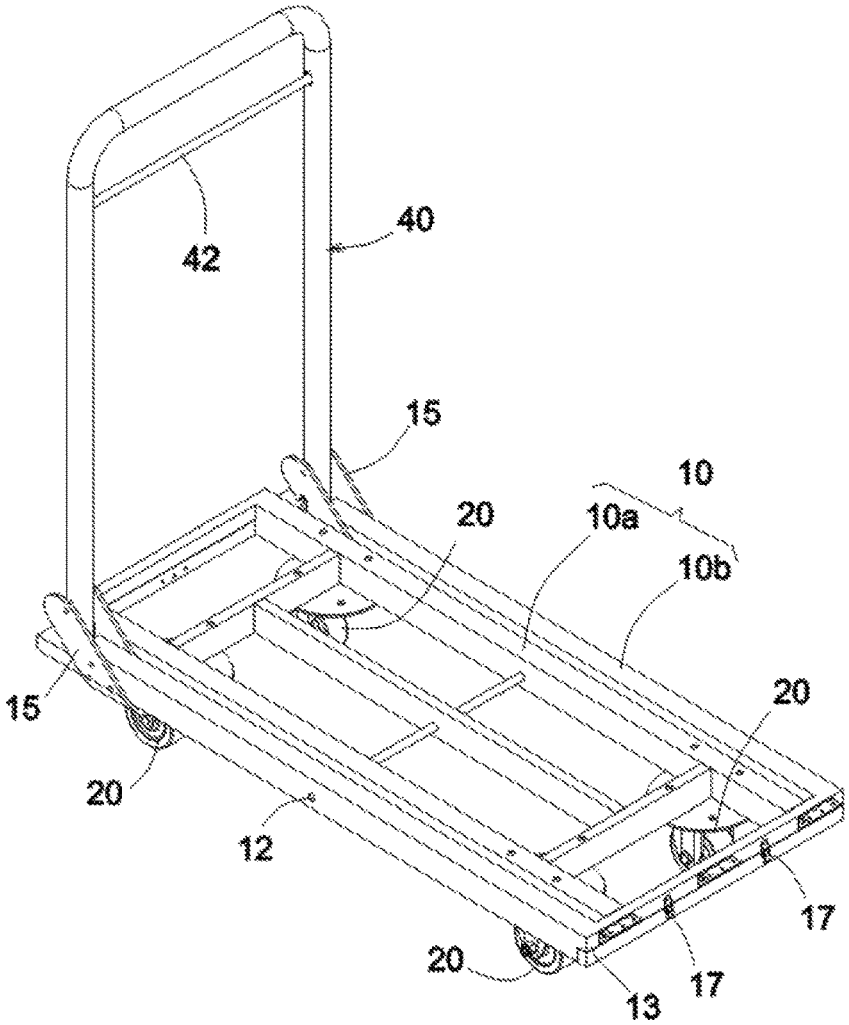
FIG. 7 is a diagram schematically showing the convertible vehicle of FIG. 6 with the carrier member being removed.

In FIG. 7, the present invention discloses a convertible vehicle having a transportation mode and a fixation mode, wherein a blocking member 13 is provided at the first end of the second framework unit 10*a*, 10*b* and located on the moving path of the first framework unit 10*a* during folding whereby when the first and second framework units 10*a*, 10*b* are folded, the blocking member is configured for blocking the first framework unit 10*a* to restrain the folding angle between the first and second framework units 10*a*, 10*b*.

Figure 9:
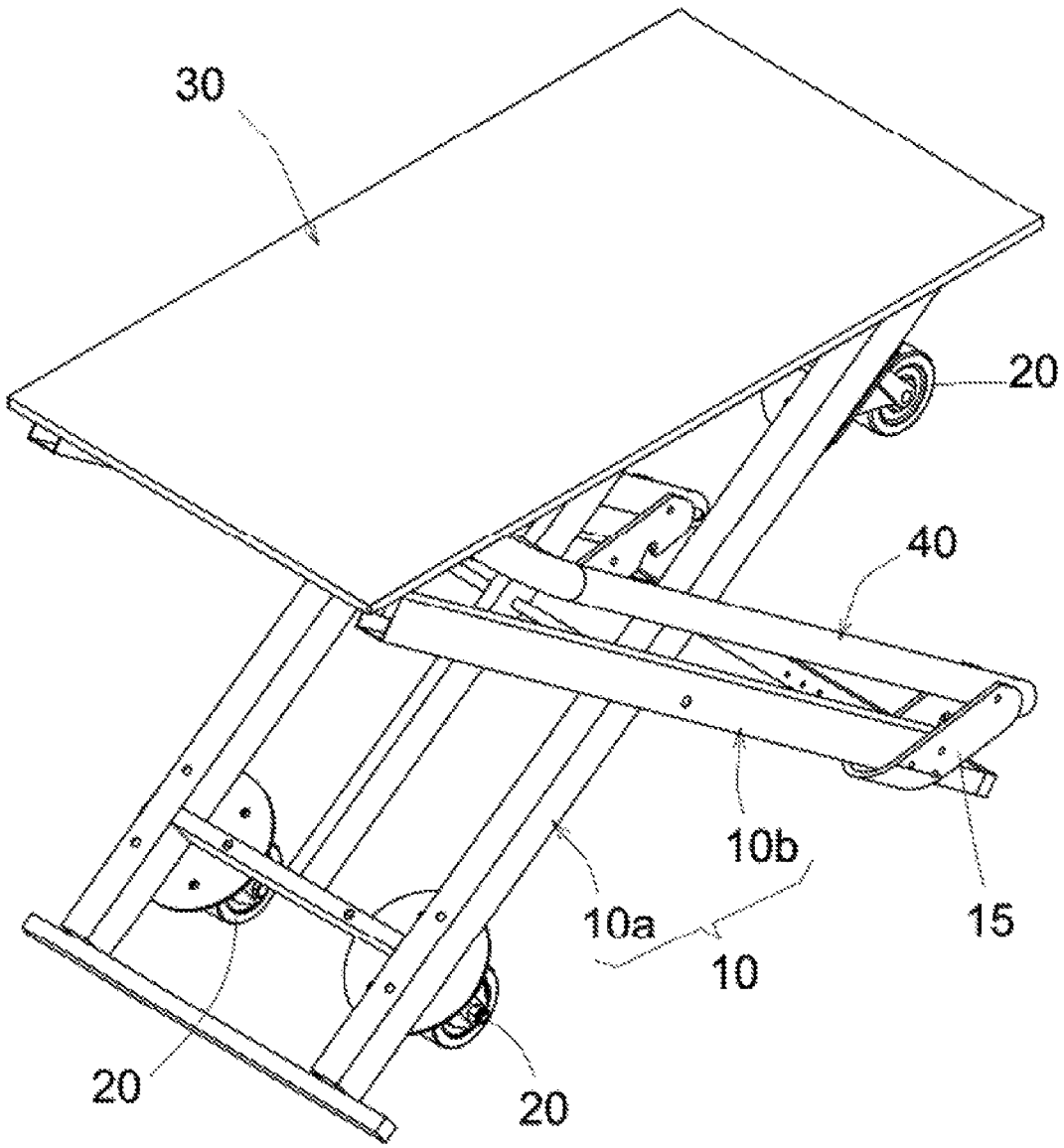
FIG. 9 is a diagram schematically showing a fixation mode of the convertible vehicle of FIG. 4.
Figure 10:
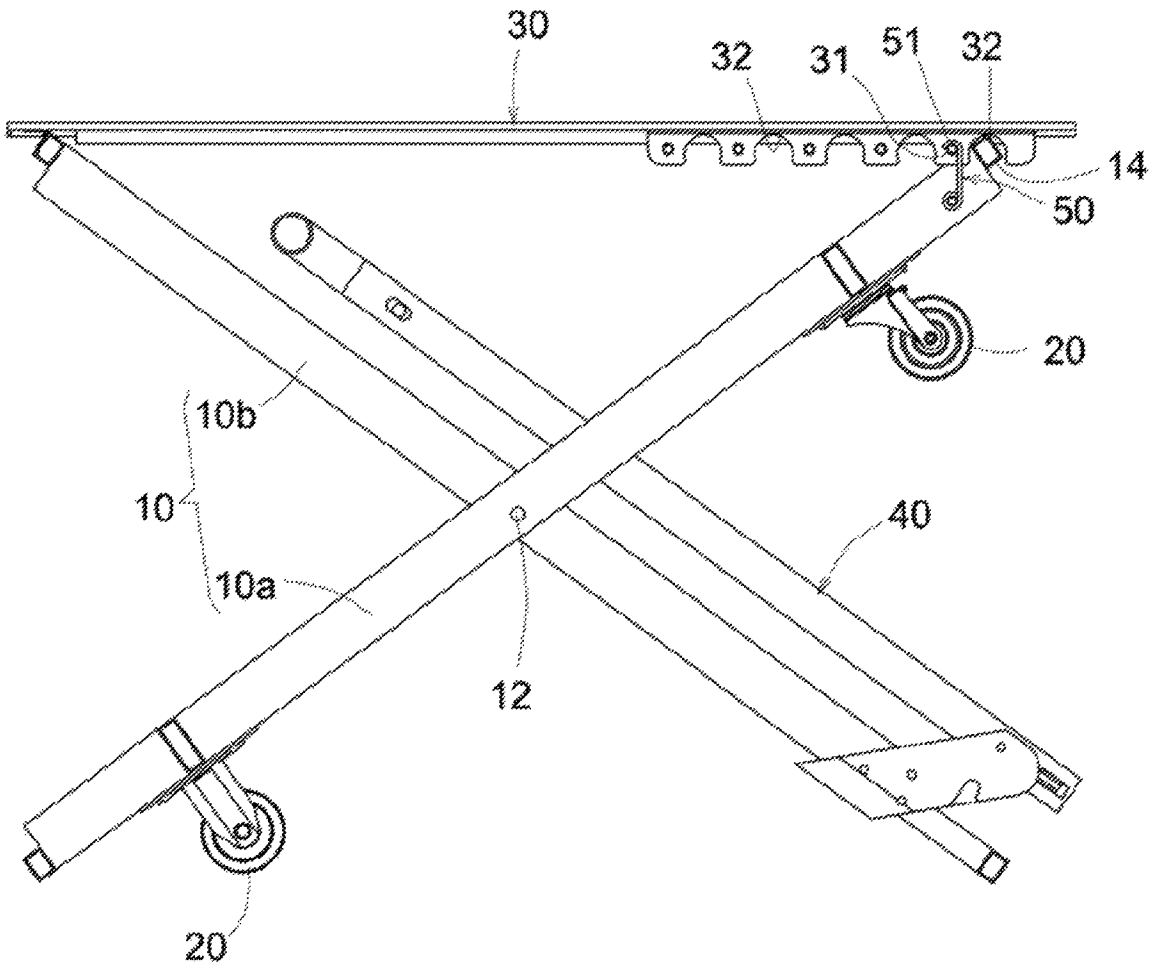
FIG. 10 is a diagram schematically showing a front plane of the convertible vehicle of FIG. 9.
Figure 11:
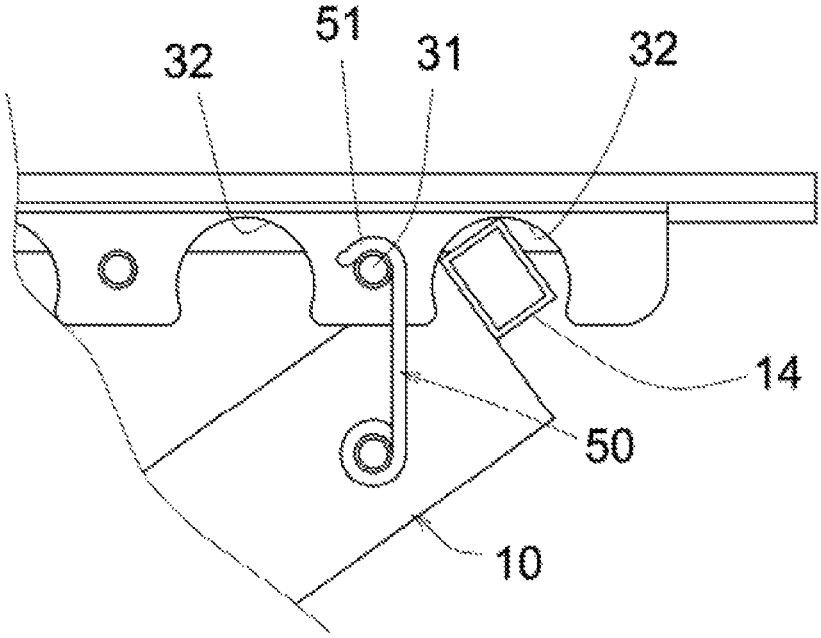
FIG. 11 is a diagram schematically showing an enlarged part of the convertible vehicle of FIG. 10.

As illustrated in FIGS. 9, 10 and 11, the present invention discloses a convertible vehicle having a transportation mode and a fixation mode, further comprising a safety lock bolt 50. The safety lock bolt 50 buckles the framework assembly 10 unfolded to the X-shape structure and the carrier member 30 for preventing the respective framework units 10*a*, 10*b* of the framework assembly 10 from moving in the folding direction to lock the framework assembly 10 in the X-shape structure in a steady manner.

As shown in FIG. 11, the above-mentioned safety lock bolt 50 is provided with one end pivotally mounted on the framework assembly 10 and the other end forming a hook 51 to buckle a pin or hole 31 provided on the carrier member 30; however, the invention is not intendedly limited to the shape or form of the safety lock bolt 50.

Figure 12:
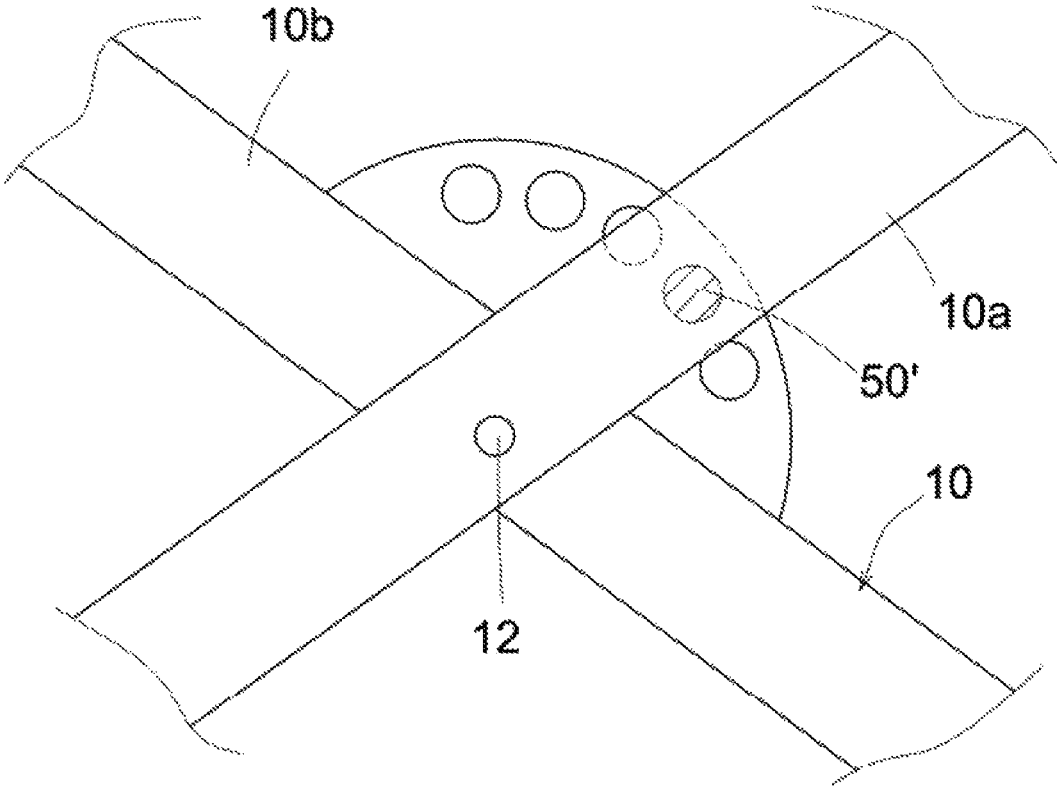
FIG. 12 is a diagram schematically showing another safety lock bolt of the convertible vehicle according to one embodiment of the present invention.

As shown in FIG. 12, the present invention discloses a convertible vehicle having a transportation mode and a fixation mode, wherein the safety lock bolt 50' buckles the X-shape structure of the unfolded framework units 10*a*, 10*b* for preventing the framework units 10*a*, 10*b* from moving in the folding direction to lock the X-shape structure of the framework assembly 10 in a steady manner. The above-mentioned safety lock bolt 50' may be but not limited to a latch.

As shown in FIGS. 9 and 10, the present invention discloses a convertible vehicle having a transportation mode and a fixation mode, wherein the framework assembly 10 is provided with a positioning member 14 and a plurality of positioning points 32 are located at the bottom of the carrier member 30. When the framework assembly 10 is unfolded to the X-shape structure, the positioning member 14 is supported against one of the positioning points 32 so as to define the unfolding angle of the framework assembly 10, horizontally support the carrier member 30 in a steady manner and form a horizontal table for usage.

Figure 4:
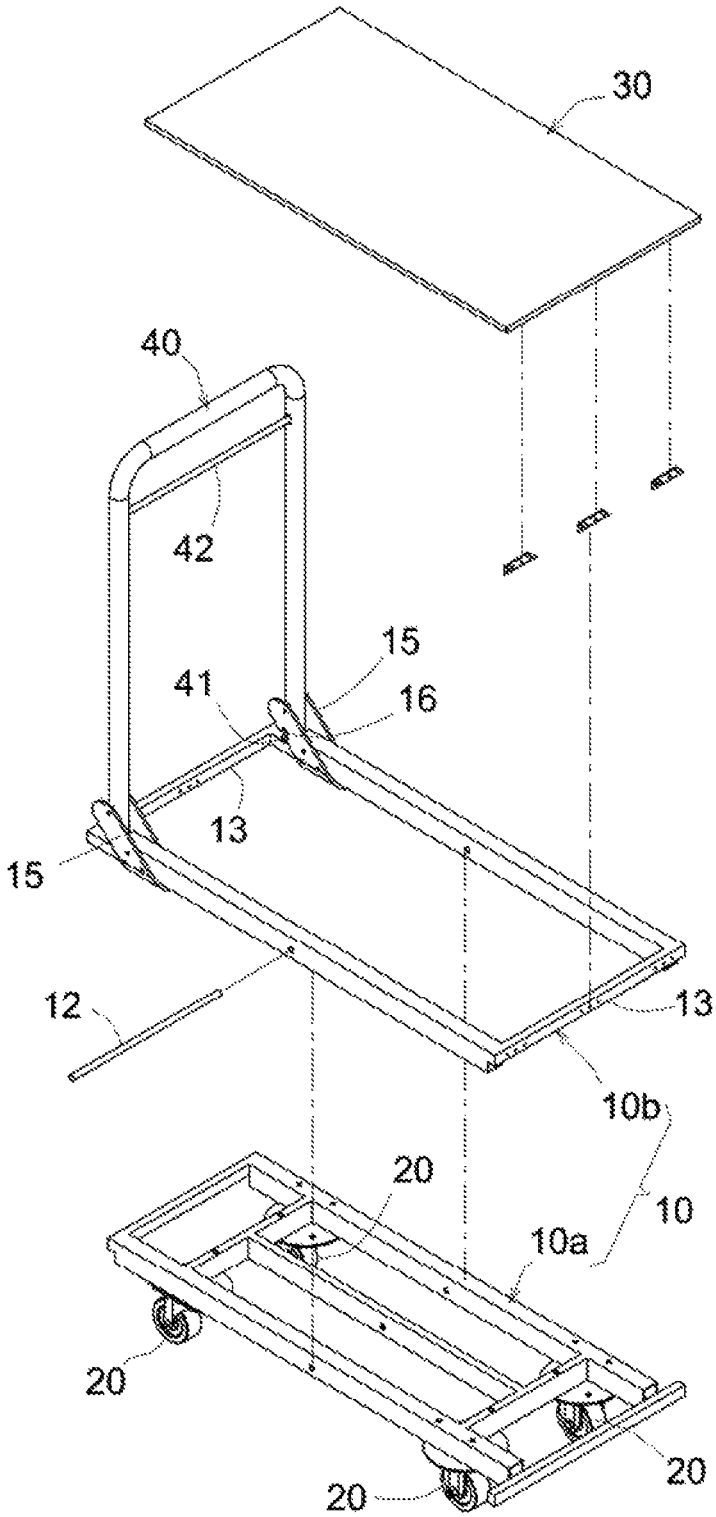
FIG. 4 is diagram schematically showing an exploded structure of the convertible vehicle having a transportation mode and a fixation mode according to one embodiment of the present invention.
Figure 5:
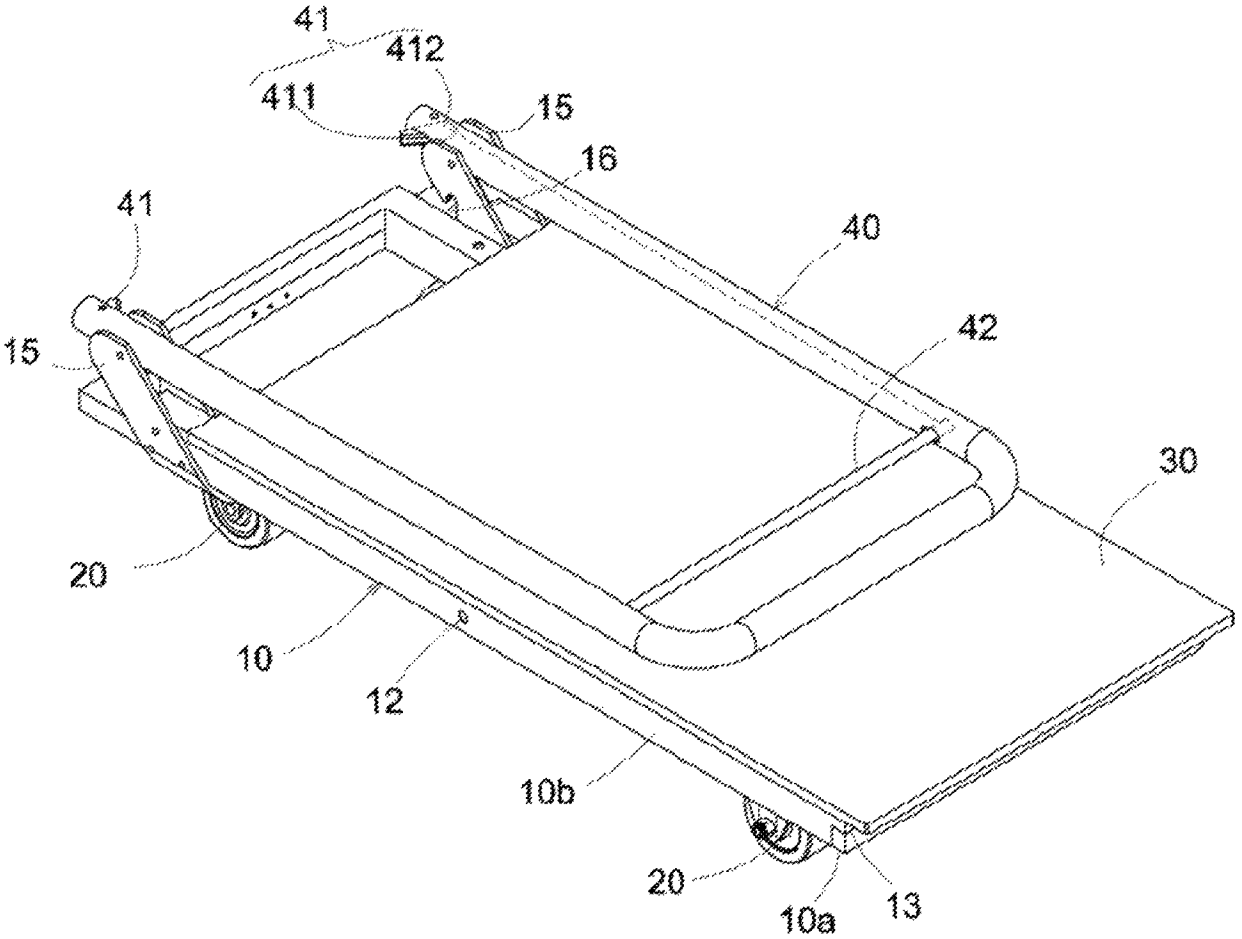
FIG. 5 is a diagram schematically showing a transportation mode of the convertible vehicle of FIG. 4.

As shown in FIGS. 4 and 5, the present invention discloses a convertible vehicle having a transportation mode and a fixation mode, wherein the framework assembly 10 is provided with at least one pivot mount 15 configured for pivotally connecting to the handle 40. The pivot mount 15 is configured with a defining member 16 for blocking the unfolding angle of the handle 40.

Figure 6:
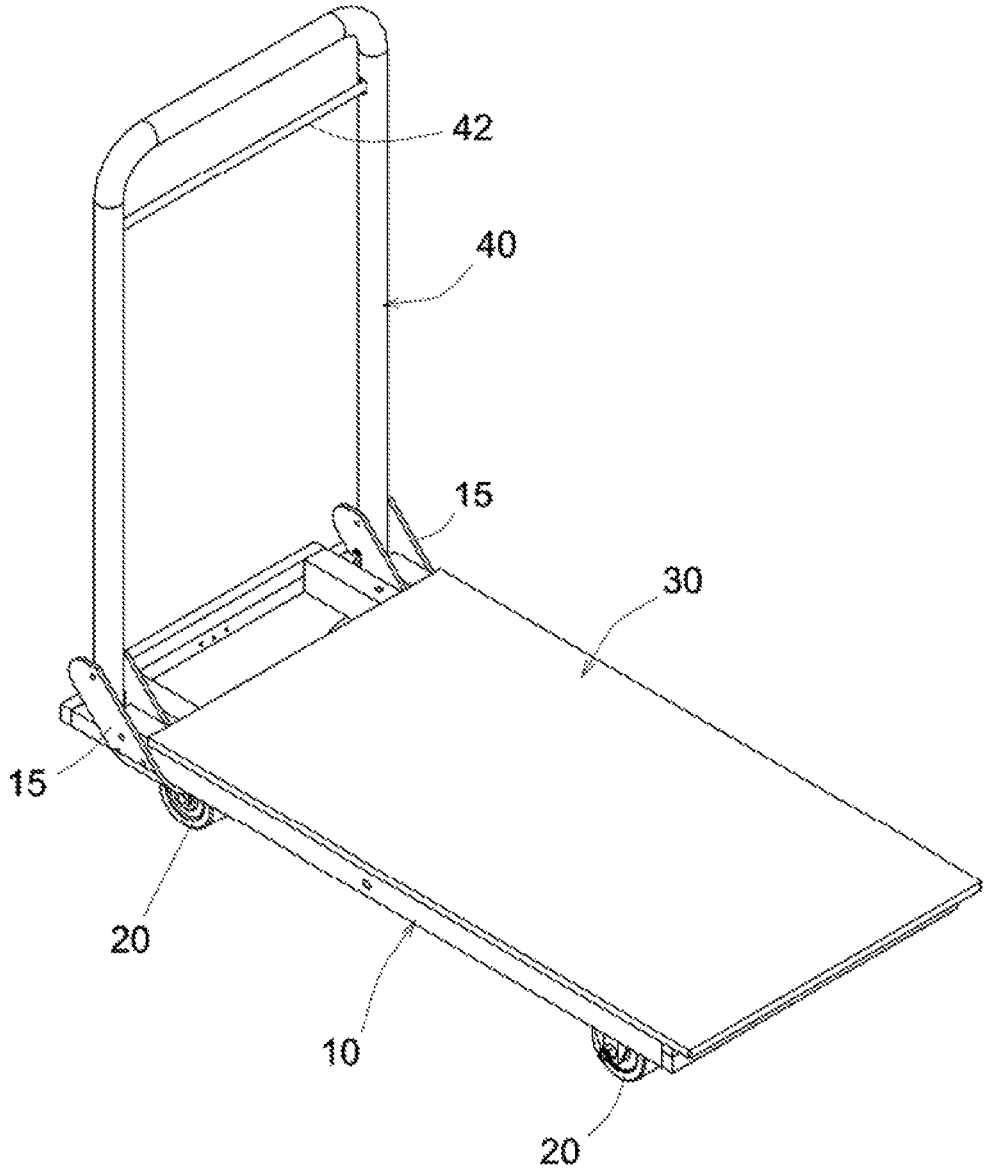
FIG. 6 is a perspective diagram of the convertible vehicle of FIG. 5 with the handle being unfolded.

As shown in FIGS. 4, 5 and 6, the present invention discloses a convertible vehicle having a transportation mode and a fixation mode, wherein the handle 40 is provided with a bolt 41. The bolt 41 may be unfolded in the direction of the framework assembly 10 and the bolt 41 may be clipped in one of limiting members 16 of the framework assembly 10 to define the unfolding angle of the handle 40.

The bolt 41 is resiliently mounted to the handle 40 so that its first end 411 normally protrudes from the handle 40 to be clipped in the limiting member 16 and its second end 412 may be pulled by a connecting rod 42 to drive the first end 411 of the bolt 41 to retract into the handle 40 to unbuckle from the limiting member 16. The above-mentioned limiting member 16 may be but not limited to a hole, a pocket, or a shoulder.

Figure 13:
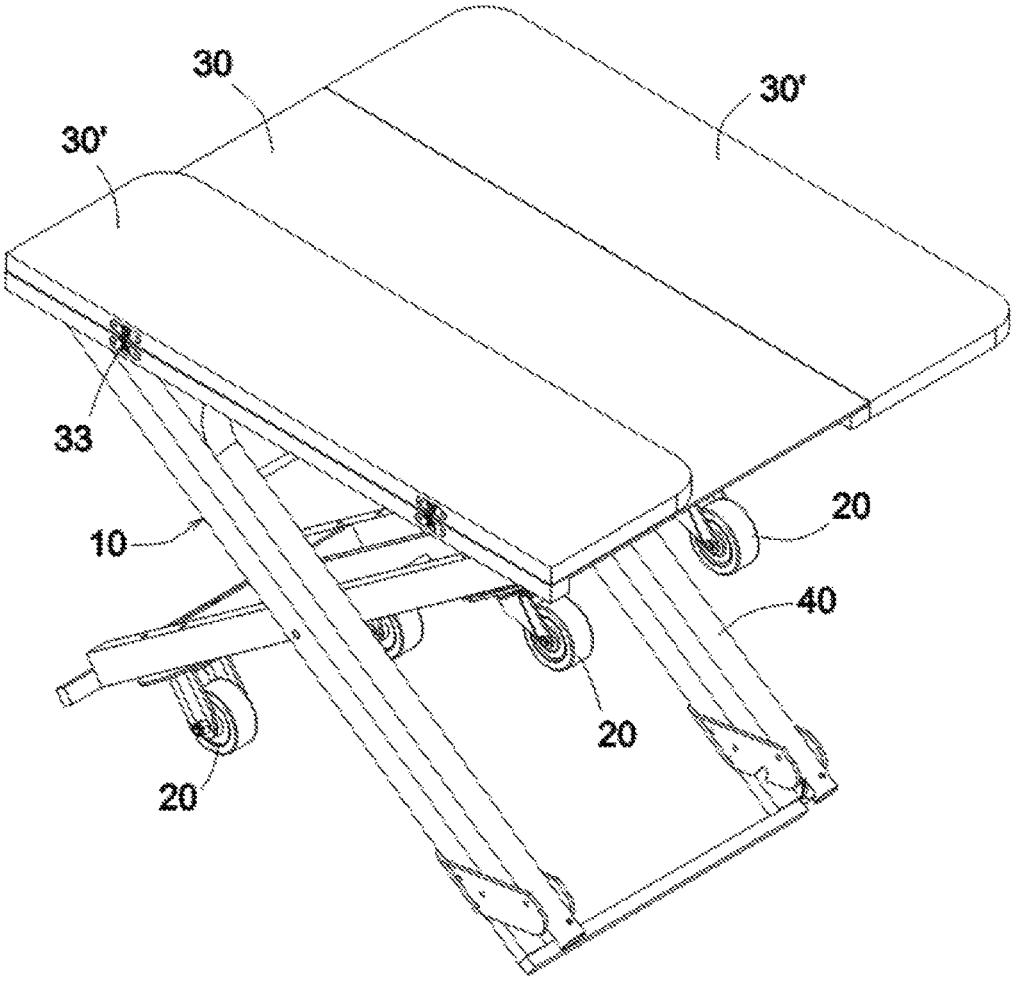
FIG. 13 is a diagram schematically showing a sub-carrier member is connected to the carrier member of the convertible vehicle according to one embodiment of the present invention.
Figure 14:
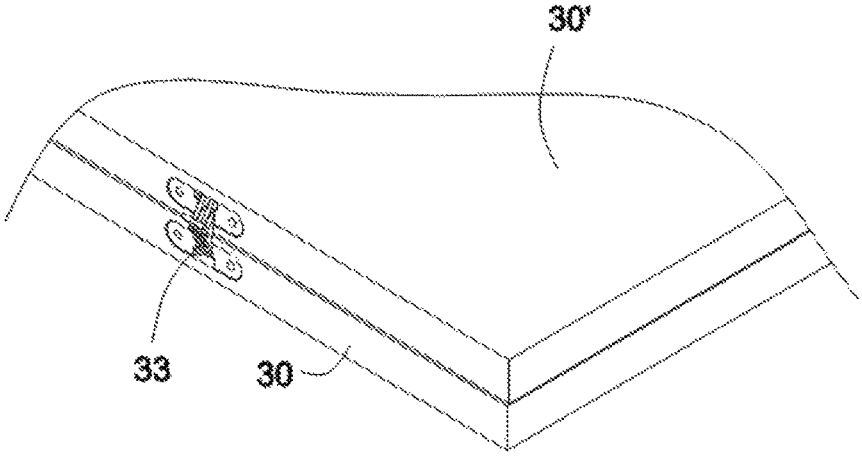
FIG. 14 is a diagram schematically showing an enlarged part of the sub-carrier member of FIG. 13.

As shown in FIGS. 13 and 14, the present invention discloses a convertible vehicle having a transportation mode and a fixation mode, wherein the carrier member 30 is further connected with at least one sub-carrier members 30'.

The above-mentioned sub-carrier member 30' can be arranged on the carrier member 30 in a sliding mode or pivotally connected to the carrier member 30 with a hinge 33. Users may open or unfold sub-carrier members 30' from the carrier member 30 to form a table with larger area in combination of the carrier member 30 to meet user's needs.

Figure 8:
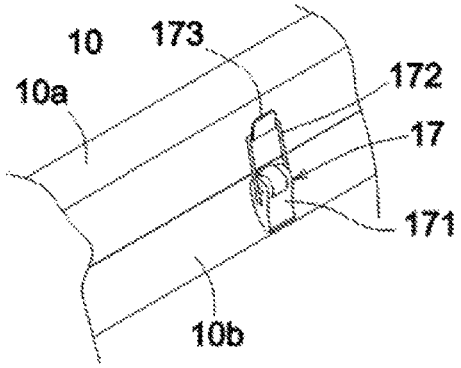
FIG. 8 is a diagram schematically showing an enlarged part of the convertible vehicle of FIG. 7.

As shown in FIGS. 7 and 8, the present invention discloses a convertible vehicle having a transportation mode and a fixation mode, wherein the framework assembly 10 further comprises at least one buckle 17. When the first and the second framework units 10*a*, 10*b* are folded, the buckle 17 is operatively locked to the first and second framework units 10*a*, 10*b* to block the first and second framework units 10*a*, 10*b* for unfolding outwardly to enhance the stability and safety of the convertible vehicle of the present invention during load transport. The above-mentioned buckle 17 may be a pin placed between the two framework units 10*a*, 10*b;* or the buckle 17 may be pivotally connected to the second framework unit 10*b* with a handle member 171 and the handle member 171 may be pivotally connected to a buckle 172 configured for correspondingly buckling to a buckle ear 173 arranged on the first framework unit 10*a* so as to lock the first and the second framework units 10*a*, 10*b*. The form of the buckle ear 173 is not intendedly limited in the present invention.

The present invention discloses a convertible vehicle having a transportation mode and a fixation mode, which may be a platform trolley without a handle. In an embodiment, the handle 40 described above may be omitted to form a platform trolley without a handle.

Figure 15:
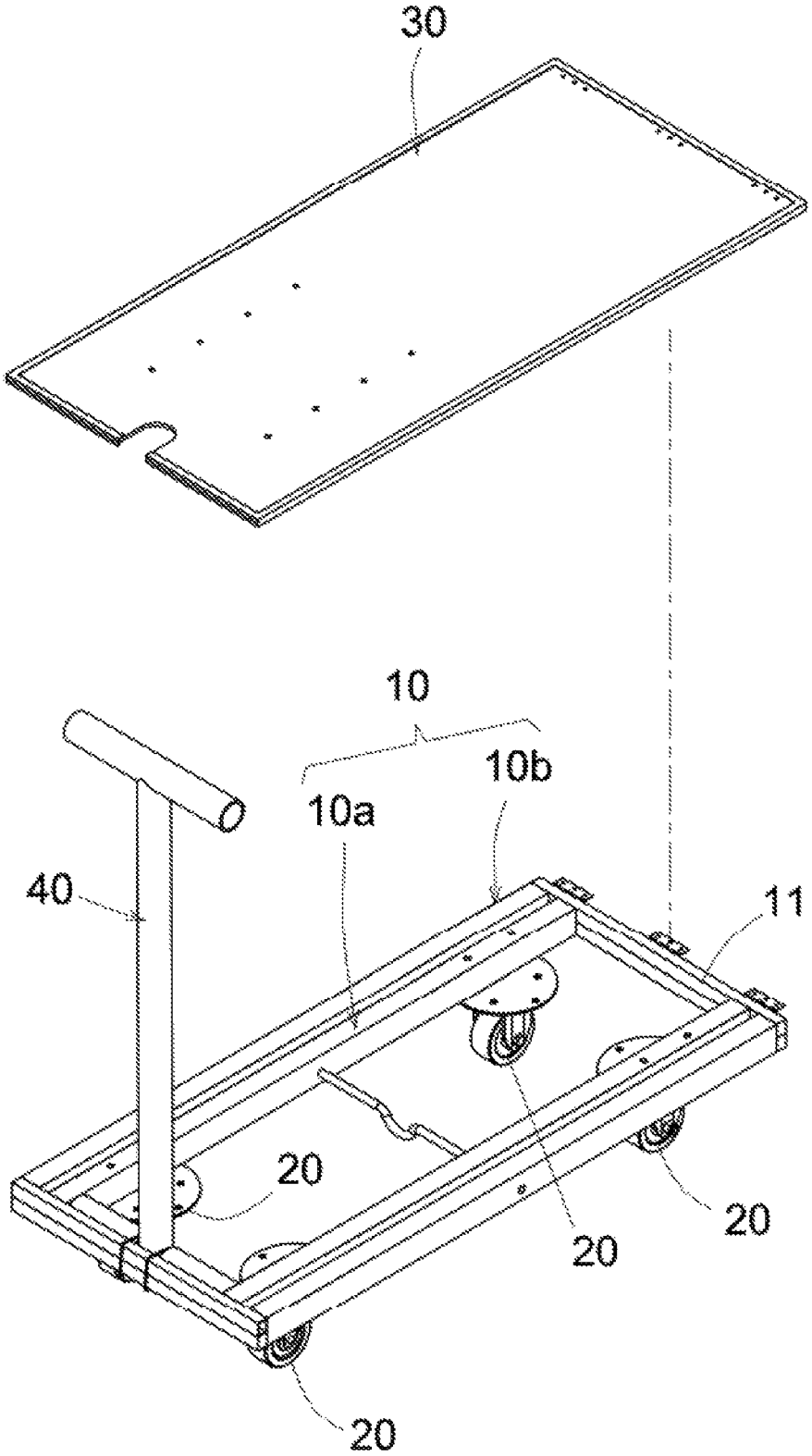
FIG. 15 is a diagram schematically showing a convertible vehicle according to a second embodiment of the present invention.
Figure 16:
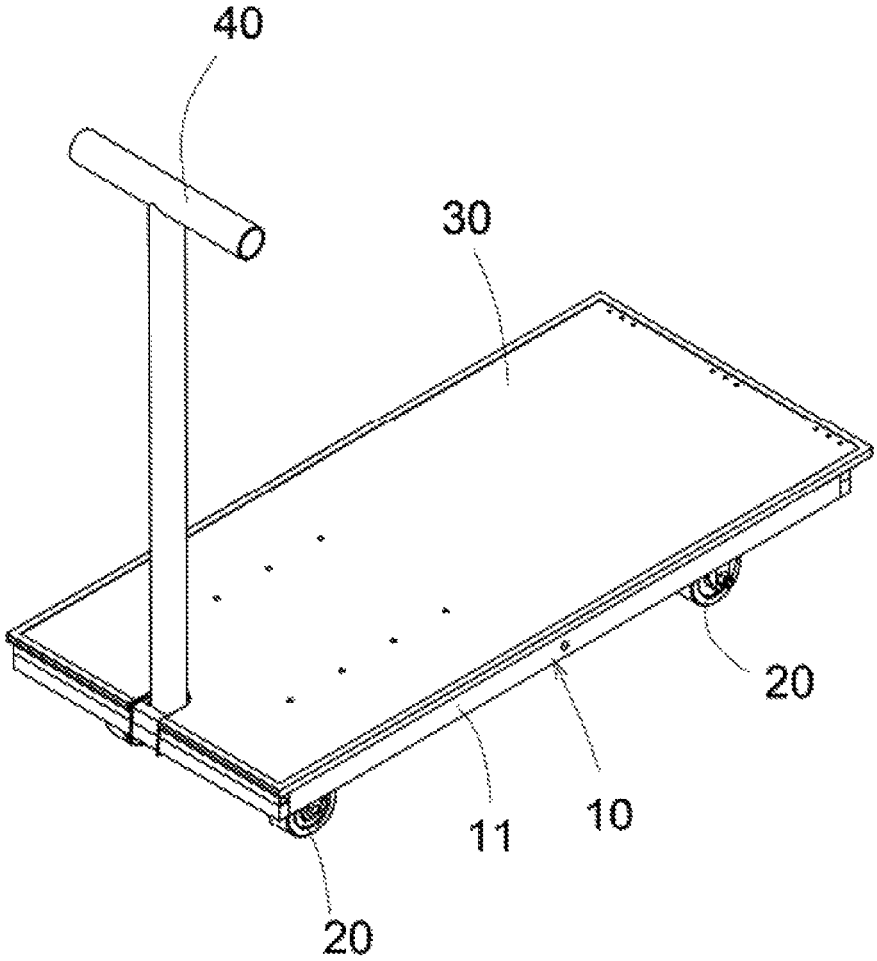
FIG. 16 is a diagram schematically showing the formation of the convertible vehicle of FIG. 15 into a trolley.
Figure 17:
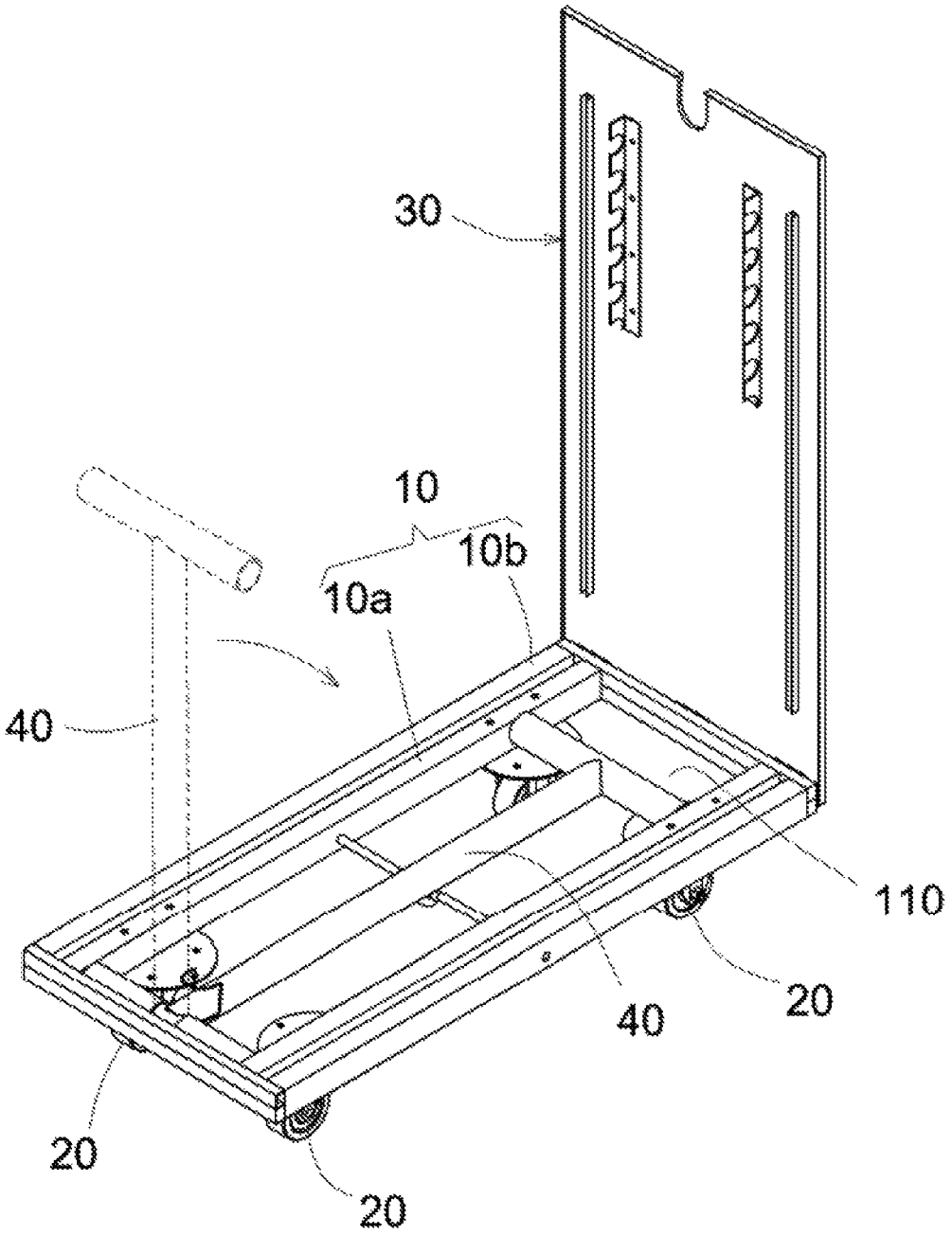
FIG. 17 is a diagram schematically illustrating the process of folding the handle of the convertible vehicle of FIG. 15 into a framework assembly.
Figure 18:
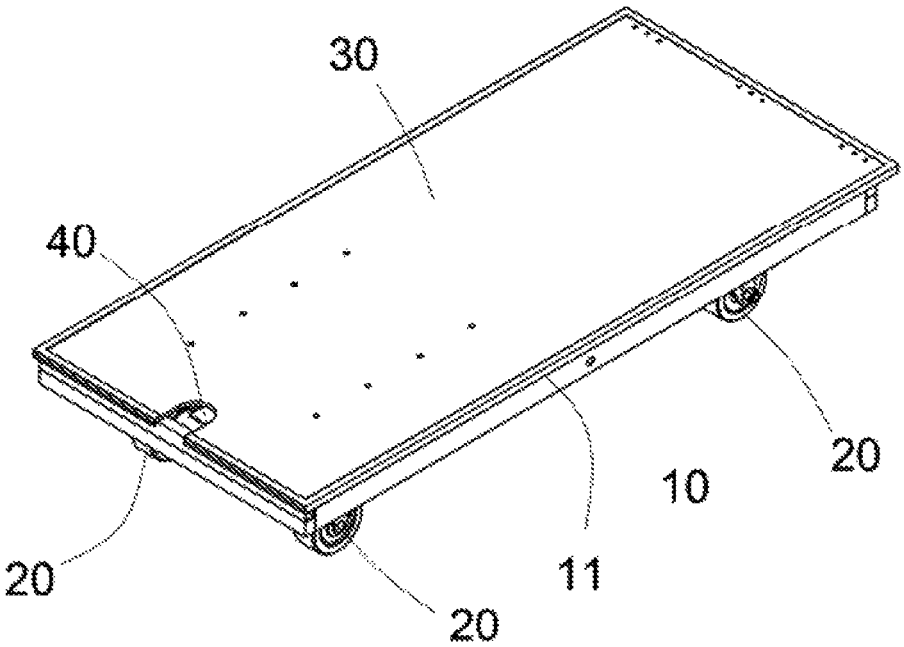
FIG. 18 is a diagram schematically illustrating placement of the carrier member of the convertible vehicle of FIG. 17 on the horizontal platform formed of the framework assembly.

The present invention discloses a convertible vehicle having a transportation mode and a fixation mode, which may be transformed between a platform trolley without a handle and a trailer trolley with a handle. In one embodiment, the handle 40 disclosed in the present invention may be in the form of an I-shaped and arranged in the space formed by the first and second framework units 10*a*, 10*b*. As shown in FIGS. 15 and 16, the handle 40 is arranged in the first framework unit 10*a*, and when the handle 40 can be unfolded with respect to the first framework unit 10*a* to 90 degrees, it is a T-shaped handle to form an application status of trailer trolley. When folded, as shown in FIGS. 17 and 18, the handle 40 may be folded in the accommodating space 110 of the first framework unit 10*a* and the carrier member 30 is placed on the horizontal platform 11 to become a mobile platform trolley so as to reduce storage space and increase the convenience of home collection. Or, as shown in FIG. 19, the first, second framework unit 10*a*, 10*b* are unfolded to an X-shape and the carrier member 30 is placed on the top of the first and second framework units 10*a*, 10*b* to form a fixation mode. In the fixation mode, a table function is provided for placing items, or a bench function is provided for users to sit down and rest.

The present invention discloses a convertible vehicle having a transportation mode and a fixation mode, which may form a trolley as a normal form in the transportation mode (as shown in FIG. 6) and form a table as a normal form in the fixation mode (as shown in FIG. 9). When used in outdoor recreational activities such as traveling, the first and second framework units 10*a*, 10*b* of the framework assembly 10 of the present invention can be firstly folded, the carrier member 30 is placed on the horizontal platform 11 consisting of the first and second framework units 10*a*, 10*b* and the handle 40 is unfolded to form a trolley in the transportation mode of a trolley. At now, users can carry objects such as picnic utensils, tents, and the like by the carrier member 30, simply transports items to the predetermined place by the wheels 20, and the framework assembly 10 of the present invention is unfold to an X-shape structure and place the carrier member 30 on the top of the framework assembly 10 in an X-shape structure to form a steady and useful table in the fixation mode for users to carry out picnic use. In the above application, the carrier member 30 disclosed in the present invention may be provided with dual functions as the carrier plate in the transportation mode as well as the table top of the table to show the economy of the invention, the convenience of the application and the simplicity of the design for novelty and non-obviousness.

While the invention is susceptible to various modifications and alternative forms, a specific example thereof has been shown in the drawings and is herein described in detail. It should be understood, however, that the invention is not to be limited to the particular form disclosed, but to the contrary, the invention is to cover all modifications, equivalents, and alternatives falling within the spirit and scope of the appended claims.

What is claimed is:

1. A convertible vehicle having a transportation mode and a fixation mode, comprising:

a framework assembly comprising a first framework unit and a second framework unit pivotally connected to each other;

a plurality of wheels being connected to the framework assembly and being all configured in one of the first framework unit and the second framework unit; and a carrier member pivotally connected to the framework assembly;

wherein in the transportation mode of the convertible vehicle, the first framework unit and the second framework unit are folded to form a horizontal platform, each of the wheels is located at a lower surface of the first framework unit or the second framework unit and located at a horizontal plane for transportation, and the carrier member is placed on the horizontal platform for carrying objects; and wherein in the fixation mode of the convertible vehicle, the first framework unit and the second framework unit are unfolded to be inclined and to form an X-shape structure, each of the wheels is located at the lower surface of the inclined first framework unit or the inclined second framework unit, and the carrier member is placed on a top of the X-shape structure for placing objects.

2. The convertible vehicle having a transportation mode and a fixation mode as claimed in claim 1, wherein a blocking member is provided at a first end of the second framework unit and configured for blocking the first framework unit to restrain a folding angle between the first framework unit and the second framework unit when the first framework unit and the second framework unit are folded.

3. The convertible vehicle having a transportation mode and a fixation mode as claimed in claim 1, wherein the framework assembly further comprises a positioning member and a bottom of the carrier member is provided with a plurality of positioning holes whereby the positioning member is supported by one of the positioning holes to define an angle at which the framework assembly is unfolded in the fixation mode of the convertible vehicle.

4. The convertible vehicle having a transportation mode and a fixation mode as claimed in claim 1, further comprising a handle pivotally mounted on the framework assembly with function of being folded along a direction toward the horizontal platform and being unfolded along a direction away from the horizontal platform to include an angle with the horizontal platform.

5. The convertible vehicle having a transportation mode and a fixation mode as claimed in claim 4, wherein the handle is capable of being folded in an accommodating space formed by one of the first framework unit and the second framework unit.

6. The convertible vehicle having a transportation mode and a fixation mode as claimed in claim 1, wherein the number of the wheels is at least three.

7. The convertible vehicle having a transportation mode and a fixation mode as claimed in claim 1, wherein the number of the wheels is four.

8. The convertible vehicle having a transportation mode and a fixation mode as claimed in claim 1, wherein the first framework unit is smaller than the second framework unit, and the first framework unit and the second framework unit are folded in an internal and external manner to form the horizontal platform in the transportation mode of the convertible vehicle.

9. The convertible vehicle having a transportation mode and a fixation mode as claimed in claim 1, wherein in the transportation mode of the convertible vehicle, the first framework unit and the second framework unit are adjacent to each other after being folded to form the horizontal platform.

10. The convertible vehicle having a transportation mode and a fixation mode as claimed in claim 1, wherein the first framework unit and the second framework unit are rectangular frames.

11. The convertible vehicle having a transportation mode and a fixation mode as claimed in claim 10, wherein each of the wheels is configured at a distance from each of the four corners of one of the first framework unit and the second framework unit.

12. The convertible vehicle having a transportation mode and a fixation mode as claimed in claim 1, wherein the first framework unit and second framework unit are pivotally connected to each other with a pivot shaft.

* * * * *